US006483231B1

(12) United States Patent
Iosue

(10) Patent No.: US 6,483,231 B1
(45) Date of Patent: Nov. 19, 2002

(54) NIGHT VISION DEVICE AND METHOD

(75) Inventor: Michael Jude Iosue, Phoenix, AZ (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 09/307,276

(22) Filed: May 7, 1999

(51) Int. Cl.[7] ..... H01J 31/50

(52) U.S. Cl. ..... 313/103 CM; 313/542; 313/103 CM; 313/105 CM; 313/530; 313/544; 250/214 VT; 250/207

(58) Field of Search ..... 313/103 CM, 103 R, 313/105 CM, 105 R, 530, 542, 384, 379, 544; 250/214 VT, 207, 214 LA

(56) References Cited

U.S. PATENT DOCUMENTS 5,493,111 A * 2/1996 Wheeler et al. ..... 313/105 CM
5,789,861 A * 8/1998 Kyushima et al. ... 313/105 CM
6,069,445 A * 5/2000 Smith ..... 313/542 X
6,331,753 B1 * 12/2001 Isoue ..... 313/542

* cited by examiner

*Primary Examiner*—Ashok Patel
(74) *Attorney, Agent, or Firm*—Marsteller & Associates, P.C.

(57) ABSTRACT

A image intensifier tube (14) includes a housing (18) carrying a photocathode (22) and a microchannel plate (24). The housing also receives axially extending fine-dimension spacing structure **(22*a*) interposed around an active area 22*b* of the photocathode and the microchannel plate to establish and maintain a selected fine-dimension, precise PC-to-MCP spacing between these structures. The housing includes yieldable deformable electrical contact structure (56') for establishing and maintaining contact with the microchannel plate, and yieldable deformable sealing structure (58)** allowing axial movement of the photocathode relative to the housing structure as the tube is assembled and the axial spacing structure controls PC-to-MCP spacing. The result is that the PC-to-MCP spacing dimension of the tube is largely isolated from dimensional variabilities of the housing and is established and maintained precisely during manufacturing of the tube despite stack up of tolerances for the housing and its components.

7 Claims, 4 Drawing Sheets

NIGHT VISION DEVICE AND METHOD

BACKGROUND OF THE INVENTION

1. Field of the Invention

The present invention is in the field of night vision devices. More particularly, the present invention relates to a night vision device which uses an image intensifier tube to amplify light from a scene. This light may be too dim to be seen with natural human vision, or the scene may be illuminated substantially only by infrared light which is invisible to human vision. The image intensifier tube both amplifies the image from the scene and shifts the wavelength of the image into the portion of the spectrum which is visible to humans, thus to provide a visible image replicating the scene. Still more particularly, the present invention relates to such an image intensifier tube having a unitary ceramic body portion, as well as a photocathode and a microchannel plate spaced from one another to define a spacing dimension, this dimension being established by structure extending axially between the photocathode microchannel plate, and establishing this spacing dimension independently of tolerances and variability's of the other components of the image intensifier tube. Methods of making of operating such an image intensifier tube are presented.

2. Related Technology

Even on a night which is too dark for natural human vision, invisible infrared light is richly provided in the near-infrared portion of the spectrum by the stars of the night sky. Human vision cannot utilize this infrared light from the stars because the infrared portion of the spectrum is invisible to humans. Under such conditions, a night vision device (NVD) of the light amplification type can provide a visible image replicating a night-time scene. Such NVD's generally include an objective lens which focuses invisible infrared light from the night-time scene through the transparent light-receiving face of an image intensifier tube ($I^2T$). At its opposite image-output face, the $I^2T$ provides a visible image, generally in yellow-green phosphorescent light. This image is then presented via an eyepiece lens to a user of the device.

A contemporary NVD will generally use an $I^2T$ with a photocathode (PC) behind the light-receiving face of the tube. The PC is responsive to photons of visible and infrared light to liberate photoelectrons. Because an image of a night-time scene is focused on the PC, photoelectrons are liberated from the PC in a pattern which replicates the scene. These photoelectrons are moved by a prevailing electrostatic field to a microchannel plate having a great multitude of microchannels, each of which is effectively a dynode. These microchannels have an interior surface at least in part defined by a material liberating secondary-emission electrons when photoelectrons collide with the interior surfaces of the microchannels. In other words, each time an electron (whether a photoelectron or a secondary-emission electron previously emitted by the microchannel plate) collides with this material at the interior surface of the microchannels, more than one electron (i.e., secondary-emission electrons) leaves the site of the collision. This process of secondary-electron emissions is not an absolute in each case, but is a statistical process having an average emissivity of greater than unity.

As a consequence, the photoelectrons entering the microchannels cause a geometric cascade of secondary-emission electrons moving along the microchannels, from one face of the microchannel plate to the other so that a spatial output pattern of electrons (which replicates the input pattern; but at an electron density which may be, for example, from one to several orders of magnitude higher) issues from the microchannel plate.

This pattern of electrons is moved from the microchannel plate to a phosphorescent screen electrode by another electrostatic field. When the electron shower from the microchannel plate impacts on and is absorbed by the phosphorescent screen electrode, visible-light phosphorescence occurs in a pattern which replicates the image. This visible-light image is passed out of the tube for viewing via a transparent image-output window.

The necessary electrostatic fields for operation of an $I^2T$ are provided by an electronic power supply. Usually a battery provides the electrical power to operate this electronic power supply so that many of the conventional NVD's are portable.

However, the electrostatic fields maintained within a conventional image intensifier tube, which are effective to move electrons from the photocathode to the screen electrode, also are unavoidably effective to move any positive ions which exist within the image intensifier tube toward the photocathode. Because such positive ions may include the nucleus of gas atoms of considerable size (i.e., of hydrogen, oxygen, and nitrogen, for example, all of which are much more massive than an electron), these positive gas ions are able to impact upon and cause physical and chemical damage to the photocathode. An even greater population of gas atoms present within a conventional image intensifier tube may be electrically neutral but also may be effective to chemically combine with and poison the photocathode.

Conventional image intensifier tubes have an unfortunately high indigenous population of gas atoms within the tube—both those gas atoms which become positive ions and those much more populous atoms that remain electrically neutral but are possible of chemically reacting within the tube. Historically, this indigenous population of gas atoms resulted both in the impact of many positive ions on the photocathode, and in chemical attack of the photocathode. With many early-generation $I^2T$'s, this resulted in a relatively short operating life.

As those ordinarily skilled in the pertinent arts will understand, later generation $I^2T$'s of the proximity focus type have partially solved this ion-impact and chemical reaction problem by providing an ion barrier film on the inlet side of the MCP. This ion barrier film both blocks the positive ions and prevents them form damaging the PC, and inhibits the migration of chemically active atoms toward the PC. However, the ion barrier film on a MCP is itself the source of many disadvantages.

A recognized disadvantage of such an ion barrier film on an MCP is the resulting decrease in effective signal-to-noise ratio provided by the MCP between a PC of an $I^2T$ and the output screen electrode of the tube. That is, although the material of the ion barrier film itself acts as a secondary emitter of electrons, but only for those electrons of sufficient energy. Electrons of lower energy may be absorbed by the ion barrier film, so that this ion barrier film acts to prevent these low energy electrons from reaching the microchannels of the MCP. Secondary-emission electrons typically have a comparatively low energy. Recalling that about 50% of the electron input face of a MCP is open area, and about the same percentage is defined by the solid portion or web of the microchannel plates, it is easily appreciated that about half of the photoelectrons impact on the web of the MCP. Moreover, these photoelectrons which impact the web of the MCP result in the production of secondary emission electrons closely adjacent to the open areas of the MCP, and with low energies. These low-energy electrons lack the energy to either penetrate the ion barrier film, or to cause this film to liberate secondary electrons. So these low energy electrons are absorbed by the ion barrier film. The result is that in some cases, as much as 50% of the electrons that would otherwise contribute to the formation of an image by the $I^2T$ are blocked or absorbed by the ion barrier film and do not reach the microchannels to be amplified as described above. Thus, about the same percentage of the image information which theoretically could be provided by the tube is lost.

Another disadvantage of the ion barrier film is that it contributes to halo effect in the image provided by the conventional image intensifier tube. This halo effect may be visualized as photoelectrons incident on the web of the MCP, or on the ion barrier film itself, either themselves not penetrating this film to enter a microchannel and to be amplified, but bouncing off to again impact the film or the web at another location. At the other location, the process is repeated, with some of the electrons entering a microchannel, and some of the electrons again bouncing to yet a third location. This effect causes a halo or emission of light around locations of the image. This halo light emission does not correspond to a bright area of the scene being viewed. This halo effect reduces the quality of the image provided by an image intensifier tube, and reduces contrast values in this image.

Another problem with image intensifier tubes using an ion barrier film is the electron voltage that must be provided (i.e., by the use of a higher applied voltage between the PC and the MCP) to photoelectrons simply to compensate on a statistical basis for the electron barrier which is represented by the film itself. The ion barrier film itself requires about 600 to 700 volts of additional applied potential.

Yet another source of image halo in conventional MCP's results from the excessive distance maintained between the PC and the front face of the MCP in these conventional $I^2T$'s. The conventional $I^2T$'s generally have a gap from PC to MCP no less than about 250$\mu$meter (+or−about 25$\mu$meter). It is recognized that an important factor in the extent or degree of halo effect is the spacing between the PC and the MCP of an $I^2T$. However, conventional $I^2T$'s have not been able to provide a spacing as small at that achieved by the present invention.

U.S. Pat. No. 3,720,535, issued Mar. 13, 1973; U.S. Pat. No. 3,742,224, issued Jun. 26 1973; and U.S. Pat. No. 3,777,201, issued Dec. 4 1973 provide examples of microchannel plates or image intensifier tubes having an ion barrier film on a microchannel plate. Also, a construction of microchannel plate relevant to this present invention is taught in U.S. Pat. No. 5,493,111, owned by the assignee of this present application, and on which the inventor of this present application is also a joint inventor.

SUMMARY OF THE INVENTION

In view of the deficiencies of the conventional related technology, it is desirable and is an object of this invention to provide a night vision device which avoids or reduces the severity of one or more of these deficiencies.

Further, it is an object for this invention to provide an image intensifier tube which overcomes or reduces the severity of at least one deficiency of the conventional technology.

Thus, it is desirable and is an object for this invention to provide an improved $I^2T$ having a spacing between the PC and the MCP of the tube which is independent of tolerances or variability's of the body of the tube.

More particularly, the present invention relates to an improved $I^2T$ having an improved housing with a portion formed of ceramic or other insulative material, and which portion provides for electrical contact with a MCP of the tube, and also allows the spacing of this MCP from the PC of the tube to be determined by a PC-to-MCP spacer(s) extending axially between the PC and MCP of the tube.

An additional object and advantage of this invention is the provision of an $I^2T$ having a high-voltage power supply in the form of an annulus which is axially aligned and stacked with the tube body (i.e., rather than in the form of an annulus surrounding the tube body), so that the envelope diameter of the tube is made smaller in comparison with conventional tubes.

Still further, an object for and advantage of this invention is the provision of an $I^2T$ having a tube body with no radially outwardly exposed or provided electrical contacts. In other words, the ceramic or other insulative body portion of the present tube body provides all electrical contacts for operation of the tube, and these are all axially aligned.

Accordingly, it is an object and advantage for this invention to provide an $I^2T$ with an axially-stacked high-voltage power supply which makes electrical connection to the tube via axially disposed contact pads of the tube body.

Further, it is an object for this invention to provide such an $I^2T$ having a MCP which is free of an ion barrier film, and thus provides an improved level of signal-to-noise in the tube.

It follows that an object for and an advantage of this invention is the provision of an $I^2T$ which has an extraordinarily low level of image halo.

To this end, the present invention according to one aspect provides a night vision device comprising an image intensifier tube having a body holding: a photocathode, a microchannel plate, and a display electrode, the image intensifier tube receiving low-level or long wavelength light and responsively providing a visible image, the image intensifier tube comprising: the body including a body ring-like portion defining a step upon which is disposed deformable electrical contact structure, this contact structure making electrical contact with the microchannel plate; and axially extending insulative spacing structure extending between the photocathode and the microchannel plate and physically touching at least one of the microchannel plate and photocathode to trap the microchannel plate in a selected axial position on the step and establish a selected fine-dimension spacing between the microchannel plate and an active portion of the photocathode, and the body further including a deformable and axially variable sealing portion sealingly uniting the body portion with a window member carrying the photocathode; whereby the axially variable sealing portion and deformable electrical contact structure cooperatively accommodate dimensional variability's for both the body portion and the window member, and the spacing dimension is independent of these dimensional variabilities.

The Applicant has discovered that, in contrast to the conventional technology, and by use of the present invention the spacing between the PC and the MCP in an $I^2T$ may be reduced. This reduction of spacing dimension may be from about 50% of the conventional value to as much as essentially an order of magnitude less than the conventional and current spacing (i.e., to substantially about 25$\mu$meter or less). Most preferably, the gap from PC to MCP may be reduced to as little as about 20$\mu$meter. The image halo image effect of the present image tube is correspondingly reduced in comparison to conventional $I^2T$'s.

Further, the $I^2T$ according to the present invention may operate on lower applied voltages between the PC and MCP, so that the applied electric field between the PC and MCP is maintained at about the same level as that employed in conventional $I^2T$'s.

A further advantage results from the reduced electron energy necessary to introduce electrons into the microchannels of the MCP in comparison to conventional image intensifier tubes. Because the microchannels of an image intensifier tube embodying the present invention are open in the direction facing the photocathode (no ion barrier film is present to restrict electron entry) the photoelectrons have essentially no barrier to overcome. This is in contrast to conventional proximity focused image intensifier tubes, which have an ion barrier on the input side of the MCP. As explained above, in conventional $I^2T$'s electrons must effectively penetrate the ion barrier to get into the microchannels of the conventional image intensifier tube. Thus, the voltage applied to the photocathode of an image tube operated according to the invention can be lowered, while still providing an adequate level of applied electric field, and while also still providing an adequate flow of photoelectrons to the microchannel plate. This advantage allows use of a smaller and lower-voltage power supply.

Still further, serial manufacturing of image intensifier tubes embodying the present invention is made considerably easier and less expensive because the fine-dimension spacing of the photocathode from the microchannel plate is independent of dimensional variabilities of the window member and of the tube housing. In other words, while conventional image intensifier tubes depend upon control of tolerance stack-up dimensions for the components of the tube body in order to control the PC-to-MCP gap, the present invention allows a deformable structure to variably yield during manufacturing of the image intensifier tube, and by so yielding to compensate for tolerances of both the window member and of the tube body. The result is both a new freedom from the necessity to control dimensional tolerances of the window member and tube body to high standards, and a heretofore unobtainable precision and repeatability in establishing the fine-dimension PC-to-MCP gap.

These and additional objects and advantages of the present invention will be apparent from a reading of the following detailed description of preferred exemplary embodiments of the invention, taken in conjunction with the following drawing Figures, in which the same reference numbers refer to the same feature, or to features which are analogous in structure or function.

BRIEF DESCRIPTION OF THE DRAWING FIGURES

FIG. 1 provides a schematic representation of a night vision device having an image intensifier tube embodying the invention;

Figure 4:
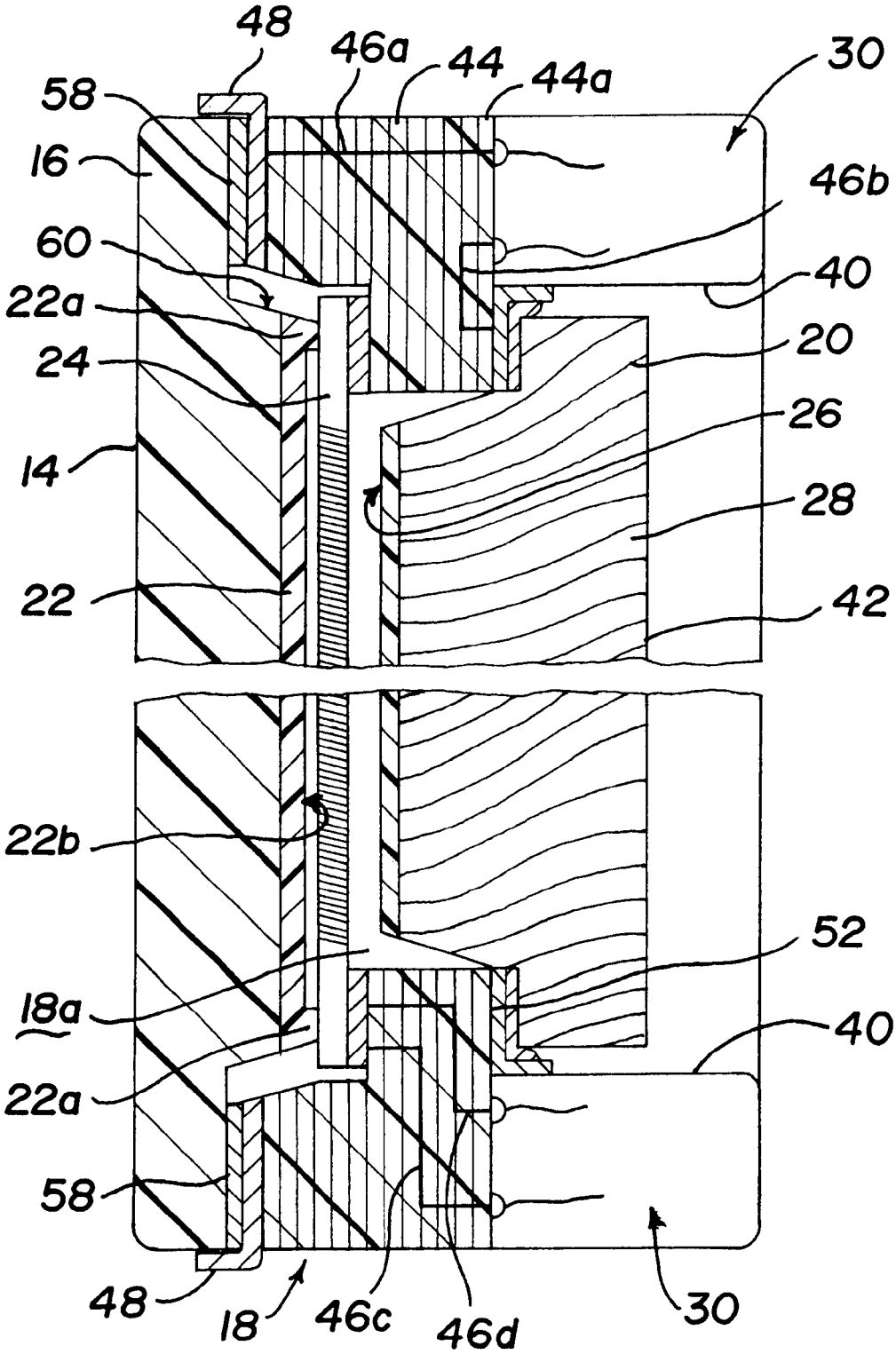
FIG. 4 is a fragmentary cross sectional view of the image intensifier tube seen in FIGS. 2 and 3, with portions of the structure rotated into the plane of this Figure for clarity of illustration.
Figure 5:
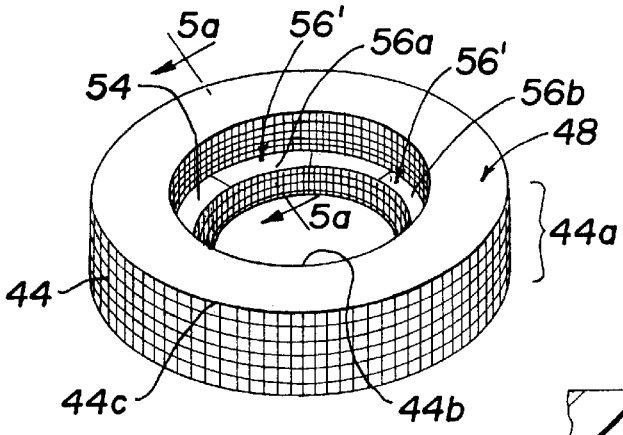
Figure 5A:
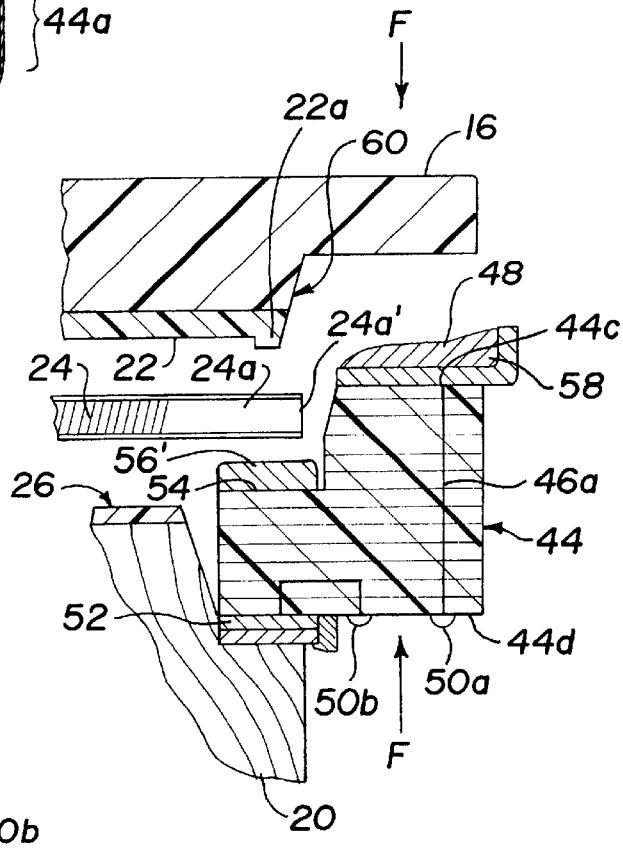
Figure 6:
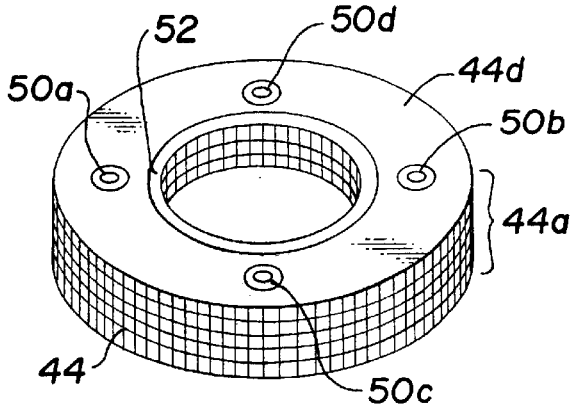
Figure 7:
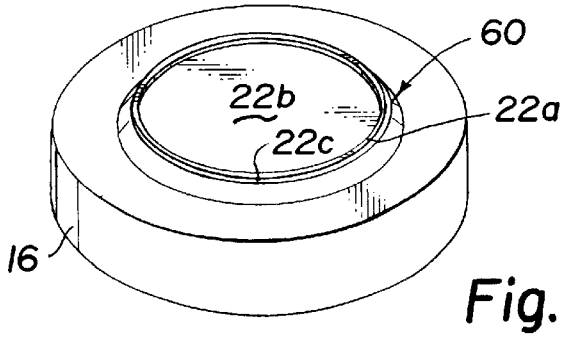
Figure 8:
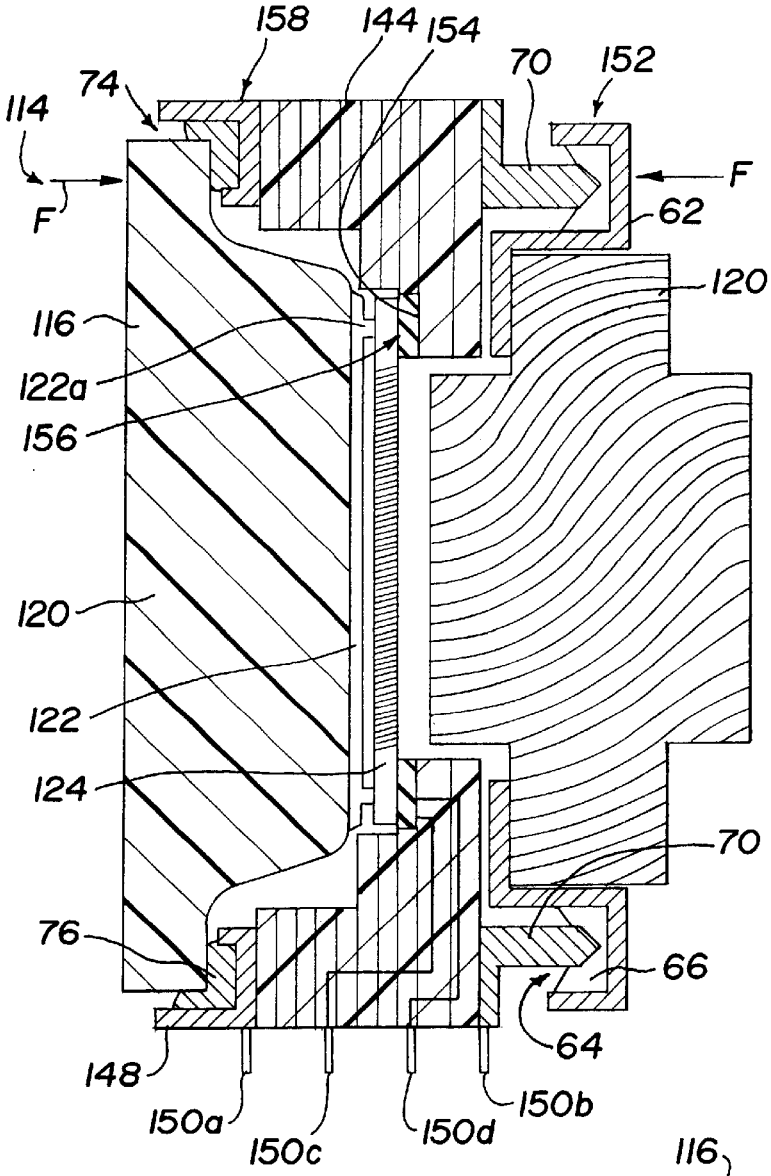
Figure 9:
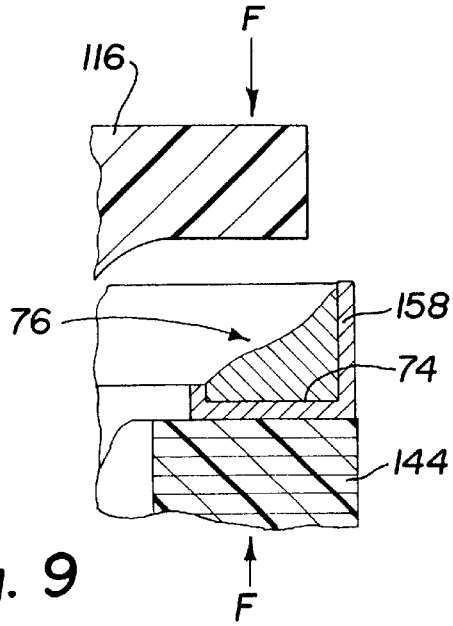

FIG. 5 provides a perspective view of the front, or light receiving side of a multi-layer laminated ceramic housing portion of the image intensifier tube seen in the preceding drawing Figures;

FIG. 5*a* is a fragmentary cross sectional view taken at a line equivalent to 5*a*—5*a* of FIG. 5, and also similar to a portion of FIG. 4, but showing the image intensifier tube at a step of manufacturing;

FIG. 6 is a perspective view of the multi-layer laminated ceramic housing portion of the image intensifier tube seen in FIG. 5, but is taken from the opposite or image output side of the housing portion;

FIG. 7 is a perspective view of a window portion of an image intensifier tube according to the present invention;

FIG. 8 is a fragmentary cross sectional view similar to FIG. 4, but showing an alternative embodiment of the invention; and FIG. 9 is a greatly enlarged fragmentary view taken at an encircled portion of FIG. 8.

DETAILED DESCRIPTION OF THE PREFERRED EXEMPLARY EMBODIMENTS OF THE INVENTION

Figure 1:
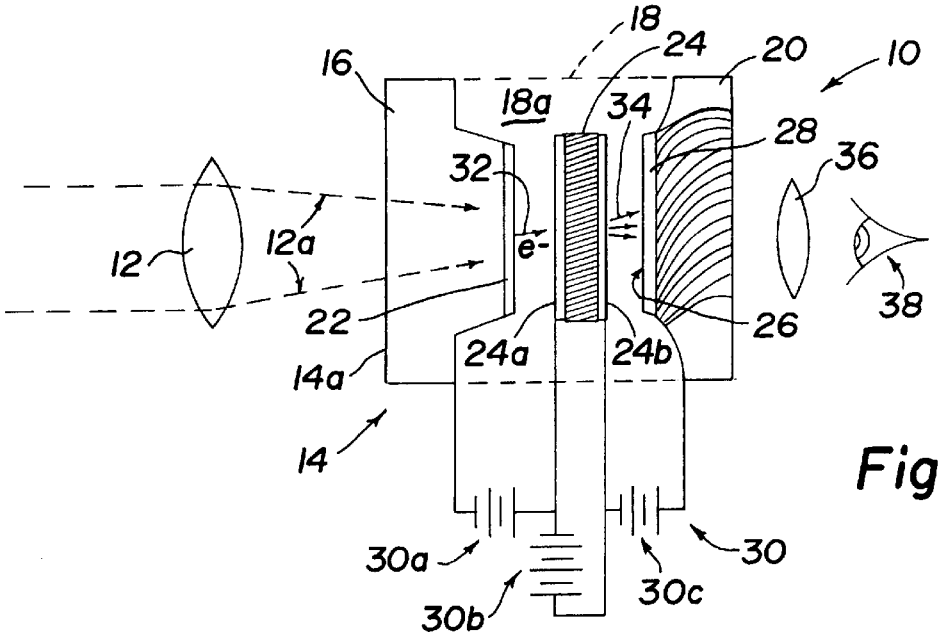

Viewing FIG. 1, a night vision device 10 includes a front objective lens 12 by which light 12*a* from a scene to be viewed is received. The light 12*a* is focused by the objective lens 12 through the front light-receiving window surface portion 14*a* of an image intensifier tube ($I^2T$) 14. The transparent window surface portion 14*a* is defined by a transparent window member 16. The $I^2T$ 14 includes a housing 18 enclosing an evacuated chamber 18*a,* The housing 18 is closed at the front or light receiving end by window member 16, at is similarly closed at a rear or image output end by a fiber optic window member 20. The window member 20 need not be fiber optic, but in this case includes fibers with a 180° twist over the thickness of the window member 20 so as to invert an image provided by the image intensifier tube 14. Within the chamber 18*a* is disposed a photocathode (PC) 22 which is carried on the inner vacuum-exposed surface of the window member 16; a microchannel plate (MCP) 24, which is carried by the housing 18 and window member 16 cooperatively as will be explained; and a display electrode assembly 26, which is carried by the window member 20. The display electrode assembly 26 generally includes an electrode coating indicated with arrowed reference numeral 26*a,* and a phosphorescent material 28 associated with (i.e., by being coated onto) this electrode 26*a*.

Those ordinarily skilled in the pertinent arts will understand that the tube 14 need not be configured so as to produce a visible image directly. That is, instead of utilizing a display electrode assembly 26, a tube embodying the present invention may include, for example and without limitation, an electronic transducer or electronic image capture device. An example of such a transducer or image capture device is a Charge Coupled Device (i.e., a CCD) which is able to respond to a flux of electrons from the MCP 24 by producing an electronic image signal. This image signal may be viewed, for example, on a liquid crystal display (i.e., an LCD), or the image signal may be transmitted to a remote location, or may be viewed on a television monitor or on a CRT. Other examples of electronic transducers or image capture devices that may be utilized in a tube embodying the present invention include CMOS image sensors, and other detectors (such as ferroelectric detectors) which provide an electronic signal in response to an electron flux.

As will be seen, prevailing electrostatic fields are created within the $I^2T$ 14 by a power supply, generally referenced with the numeral 30, This power supply 30 includes a section 30*a* which provides a voltage differential between the PC 22 and a facial electrode 24*a* carried on the MCP 24. Another section 30*b* of the power supply 30 maintains a differential voltage between the electrode 24*a* and another facial electrode 24*b* carried on the opposite face of the MCP 24. Finally, a power supply section 30*c* maintains a voltage differential between the facial electrode 24*b* and the electrode coating 26*a*. In each case, the differential voltages are most negative toward the left end of the $I^2T$ 14 as seen in FIG. 1 (i.e., at the PC 22), and most positive toward the electrode 26*a* at the right side of this drawing Figure.

The photons of light 12*a* cause PC 22 to liberate photoelectrons 32 (also indicated on Figure 1 with the arrowed symbol $e^-$) in a pattern which replicates the image of the scene focused by objective lens 12 thought window 16 and onto the PC 22. Photoelectrons from PC 22 move under the effect of the applied voltage field to MCP 24 and pass into microchannels of this MCP to cause proportionate release of secondary-emission electrons. These secondary-emission electrons are emitted in numbers far greater than the number of photoelectrons. Consequently, a shower 34 of secondary-emission electrons is discharged from MCP 24, and proceeds to the electrode 26*a* under the effect of the applied voltage field. At the display electrode assembly, the shower of electrons 34 interacts with the phosphor material 28 to cause luminescence in a pattern which matches the image received on PC 22. The luminescence of the phosphor 28 provides visible light. Consequently, the image which is created at display electrode assembly 26 is conducted outwardly of the $I^2T$ 14 by the image output window 20.

The device 10 also includes an eyepiece lens 36 which projects the image from the window 20 to a user of the device, who is indicated by the arrowed numeral 38 and the eye symbol in FIG. 1.

Figure 2:
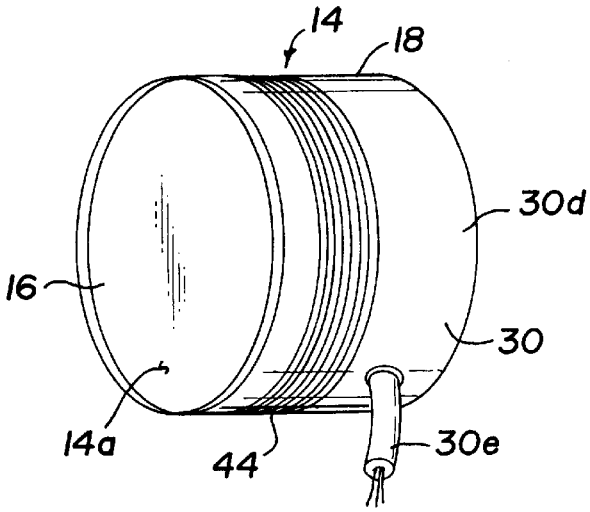
FIG. 2 is a perspective view of an image intensifier tube embodying the present invention, and showing a front light-receiving window of the tube.
Figure 3:
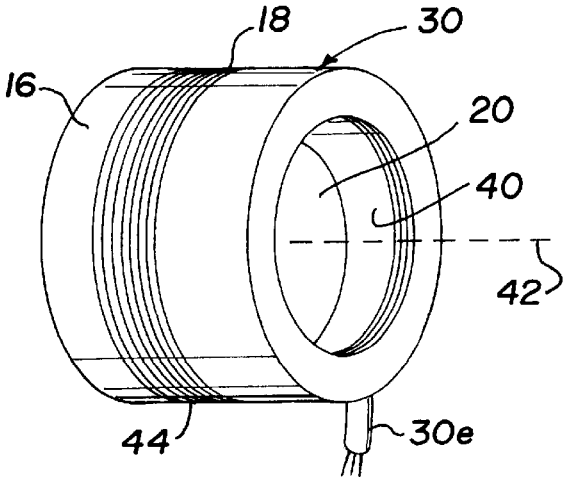
FIG. 3 is a perspective view of the image intensifier tube seen in FIG. 2, but is presented from the opposite end and shows a portion of an image output window of the tube within an annular high-voltage power supply of the tube.

Turning now to FIGS. 2 and 3 in conjunction with one another, it is seen that the $I^2T$ 14 includes a housing 18 which is generally cylindrical and round in end view. The window member 16 forms the front or light receiving end of the housing 18, and the window member 20 forms a comparatively smaller diameter opposite end of this housing 18. Carried on the housing 18 adjacent to and partially surrounding the window member 20 is an encapsulated high voltage power supply, the exterior encapsulation of which is indicated in FIG. 2 by the numeral 30*d*. Within this encapsulation 30*d*, an electronic circuit 30 (recalling FIG. 1) provides the high voltage values that were diagrammatically indicated in FIG. 1 with the reference numerals 30*a*, 30*b*, and 30*c*. An electrical connections, such as a cable 30*e* connects with the encapsulation 30*d* in order to provide electrical energy (i.e., such as from a battery) to the power supply circuit 30 to operate the $I^2T$ 14. In FIG. 3 it is seen that the encapsulation 30*d* for the power supply circuit 30 defines an opening 40 for an image passage 42 (indicated by dashed line on FIG. 4) allowing light from the display electrode assembly 26 to pass outwardly through the window member 20 and to the user 38 (i.e., via eyepiece lens 36 as well).

Further noting FIGS. 2 and 3, but turning attention now to FIG. 4 as well, it is noted that the housing 18 of the $I^2T$ includes a unitary laminated portion 44 which extends axially between the window portions 16 and 20. As will be further explained, this housing portion 44 defines a stepped through bore 44*b*, and is sealingly united with each of the window portions 16 and 20 in order to define the vacuum chamber 18*a*. Housing portion 44 also carries and provides for electrical interconnection of the $I^2T$ 14 with the power supply circuit 30 (i.e., within encapsulation 30*d*). Thus, it is understood that the image intensifier tube 14 as seen in FIGS. 2, 3, and 4 is actually an assembly of the tube 14, and its encapsulated high-voltage power supply 30.

As FIG. 4 illustrates, and viewing now FIGS. 5, 6, and 7 in conjunction with FIG. 4, the housing portion 44 is defined cooperatively by a multitude of ceramic sub-layers, indicated collectively with the arrowed numeral 44*a*. In making of the housing portion 44, the multitude of green-state ceramic sub-layers 44*a* are fabricated individually, which allows them to be stacked and laminated with one another while the ceramic material is in its green state. Subsequently, the stacked ceramic assembly which is to become the housing portion 44 is fired at an elevated temperature to permanently and sealingly bond the multiple ceramic sub-layers 44*a* into a unitary body, which upon completion of other manufacturing steps becomes the body portion 44. Consequently, it is seen that the housing portion 44 is unitary, and of a single piece of ceramic (although this single piece of ceramic is of multiple layers and includes other structures). In this preferred embodiment, the housing portion 44 is fabricated principally of ceramic, but the invention is not so limited. For example, glass might possibly be used to fabricate the housing portion 44.

Importantly, during the manufacturing operations leading to the creation of the unitary housing portion 44, plural conductive pathways or vias 46 are created in and through the ceramic material of the housing portion 44. These vias 46 may be created by providing metallic sections in the respective sub-layers 44*a* which contact on another when these sub-layers are stacked together, for example. Alternatively, portions of ceramic material that are sufficiently loaded with conductive material that they will conduct the necessary voltage and current levels for the $I^2T$ 14 might be employed to construct the vias 46. Still more particularly, multiple conductive pathways 46 are created in the stacked thin ceramic sub-layers which, when these sub-layers are stacked and interbonded to become a unitary body, connect with one another in the finished housing portion 44 as is described immediately below.

Thus, in order to connect the PC 22 outwardly of the $I^2T$ to the power supply 30, a conductive via 46*a* is created leading from a conductive, preferably metallic flange member 48, which is carried upon a planar annular front end surface 44*c* of the housing portion 44. Conductive via 46*a* leads to a contact pad 50*a* (best seen in FIG. 6) on the opposite planar annular end surface 44*d* of the housing portion 44. Similarly, in order to connect the electrode 26*a* outwardly on the housing 18, a conductive via 46*b* is created leading from a metallic flange 52 carried upon the planar annular rear end surface 44*d* of the housing portion 44 to a contact pad 50*b* (again best seen in FIG. 6) on the rear end surface 44*d*. In this same way, vias 46*c* and 46*d* extend from a step 54 defined inwardly of the housing portion 44 to respective contact pads 50*c* and 50*d* on the surface 44*d*. The window member 20 sealingly bonds to indium filled flange 52.

As is seen in FIG. 4, the annular encapsulation 30*d* for the power supply circuit 30 abuts the surface 44*d*, and the power supply circuit 30 makes respective electrical contact with the contact pads 50*a–d*, recalling the schematic representation of FIG. 1. It will be noted viewing FIGS. 4 and 6 that for convenience of illustration, the contact pads 50*a–d* have all been shown in FIG. 4 as residing in the plane of this cross sectional illustration. FIG. 6, however, correctly shows that these contact pads are most preferably spaced circumferentially from one another about the circumference of the surface 44*d*. Also, it is to be noted that contact pads 50*a* and 50*b* are diametrically opposite to one another.

Considering FIGS. 4, 5, and 5*a*, it is seen that the step 54 carries an even number (six in this case) of circumferentially extending and circumferentially spaced apart metallized contact areas 56. These contact areas 56 include three contact areas 56*a* alternating circumferentially with three contact areas 56*b*. The contact areas 56*a* are for connection with the electrode 24*a*, and the contact areas 56*b* are for connection with the electrode 24*b*. The contact areas 56*a* connect with via 46*c* and contact pad 50*c*, while the contact areas 56b connect with via 46*d* and contact pad 50*d*. Consistently with the teaching of U.S. Pat. No. 5,493,111, the microchannel plate 24 has a circumferentially discontinuous and circumferentially extending peripheral portion of electrode 24*b* which makes contact with the contact pads 56*b*.

Circumferentially intermediate or interdigitated on the same face of the MCP 24 with these portions of the electrode 24*b* are like circumferentially extending and discontinuous portions of the electrode 24*a*. That is, a part 24*a*'(seen in FIG. 5*a*) of the electrode 24*a* wraps around the outer circumferential periphery of the microchannel plate 24 to connect with a tab like part of the electrode 24*a* which is disposed on the same side of this plate structure as is the electrode 24*b*. In other words, the MCP 24 has present on its output face electrical contacts for both the electrode 24*a* and for electrode 24*b*. For a complete discussion and disclosure of this MCP construction, see U.S. Pat. No. 5,493,111, owned by the assignee of this present application, and on which the inventor of this present application is also a joint inventor.

Further, viewing FIG. 5*a* in greater detail, it is seen that upon the metallized contact areas 56*a* and 56*b* (i.e., on step 54), the housing portion 44 carries a deformable metallic contact pad structure, each indicated with the numeral 56'. These deformable contact pad structures 56' are yieldable but shape-retaining, and are seen in FIG. 5*a* at a time before the uniting of the window 16 and housing portion 44. In this preparatory condition, the contact pad structures 56' have a height that is greater than that seen in FIG. 4. As will be explained, during manufacturing of the $I^2T$ 14, the contact pad structures 56' are deformed from their as manufactured, preparatory height as seen in FIG. 5*a*, to a lesser height which is dependent upon dimensional variabilities in the components of the $I^2T$ 14.

Still considering FIGS. 5, 5*a*, and 6, and returning attention once again to FIG. 4, it is seen that the MCP 24 is trapped upon step 54 and in electrical contact with the contact pads 56*a*, 56*b*. MCP 24 is trapped in this position by an axially extending insulative rim portion 22*a* which is integral with the photocathode structure 22. That is, the axially extending rim portion 22*a* is insulative, circumferentially extending, and projects axially from (i.e., rightwardly in FIG. 4) a position about an active surface area 22*b* of the MCP 22. This active surface area 22*b* is centrally located in the photocathode structure 22 in order to align this surface area with the multitude of microchannels in the MCP 24. The active surface portion 22*b* is effective to release photoelectrons toward the MCP 24 when the PC is illuminated by light focused through the window member 16. Preferably, the insulative rim portion 22*a* extends axially about 20 microns and has an axially disposed face (indicated with arrowed reference numeral 22*c* in FIG. 6) which confronts and contacts the MCP to space this MCP away from the active surface area 22*b*. Further, it is seen in this respect that the MCP is carried by the housing portion 44 and PC 22 (on window member 16) in cooperation with one another.

Also seen in FIG. 5*a* is a deformable annular seal structure 58. This seal structure is carried by the metallic flange 48 and bonds deformably and sealingly with window member 16 when these parts are assembled. As is seen in FIG. 5*a*, the seal structure 58 (similarly to contact pad structures 56') has a preparatory height that is higher than the completed height for this seal as seen in FIG. 4. Most preferably, the contact pads 56' and deformable portion of seal structure 58 both employ a yieldable, sealingly deformable and bondable seal material including indium metal. This seal material including indium metal will allow the deformable contact pad structures 56' and deformable seal structure 58 both to, yield, cold flow and sealingly cold weld when the components of $I^2T$ 14 are assembled. As FIG. 5*a* shows, the MCP 24 is placed on step 54, with the electrodes 24*a* and 24*b* in electrical contact with the appropriate ones of the contact pads 56' and underlying contact areas 56*a* and 56*b*. Then the window member 16, carrying PC 22 is positioned over the housing 44, and opposing forces (indicated by force arrows "F" in FIG. 5*a*) are applied. The result is that the window member 16 bonds at seal structure 58 to metallic flange member 48, with the seal structure yielding and deforming to allow window member 16 to move axially toward housing 44. Simultaneously, the rib 22*a* contacts MCP 24, and applies force through this MCP structure so that the contact pads 56' also yield, deform, and allow the MCP 24 to move toward step 54.

As this assembly process is being carried out, the spacing dimension between the active area 22*b* of the PC 22 and the MCP 24 is precisely maintained by the rim 22*a*. A variety of expedients may be used to control this bonding process. For example, a force-versus displacement logging method may be used to plot the displacement of window member 16 toward housing 44. Alternatively, electrical conductivity between the MCP 24 and the contact areas 56 may be monitored. Still alternatively, a measurement of capacitance between PC 22 and MCP 24 may be used to determine when the proper combination of deformation of the seal structure 58 and of the contact pads 56' has been achieved.

After the bonding process of FIG. 5*a* has been completed, the power supply 30 is united with the housing 44 to make the completed $I^2T$ 14 as is seen in FIG. 4. In order to electrically connect the PC 22 to the seal structure 58 (and to metallic flange member 48, via 46*a*, and contact pad 50*a*) the window member 16 also carries a surface metallization, which is indicated with arrowed reference numeral 60. This surface metallization extends between the metallic flange member 48 and seal structure 58 and the outer peripheral portion of PC 22 which is exposed outwardly of peripheral rim 22*a*.

Again returning to consideration of FIG. 6, it is seen that the contact pads 50*a–d* have a progressively more negative voltage toward the left side of this housing portion as seen in FIG. 6, and a progressively more positive voltage toward the right side as seen in FIG. 6. That is, the most negative contact pad is pad 50*a*, with pads 50*c* and 50*d* being diametrically opposite to one another, of intermediate voltage level and both lower in voltage level than pad 50*a*. Further, both pads 50*c* and 50*d* are more negative than pad 50*b*, which is diametrically opposite to pad 50*a*. This arrangement of the pads 50*a–d* creates the lowest possible differential voltages between each of the contact pads 50*a–d*, and simplifies circuit arrangement in the power supply 30.

FIGS. 8 and 9 illustrate an alternative embodiment of the present invention. Because this alternative embodiment has many features that are similar to those depicted and described above, these features and features which are analogous in structure or function to those described above, are indicated on FIGS. 8 and 9 with the same numeral used above, and increased by one-hundred.

Viewing now FIGS. 8 and 9, it is seen that an $I^2T$ 114 includes a housing 144. A window member 116 forms the front end of the housing 144, and a window member 120 forms an opposite end of the housing. In this case, the power supply for the $I^2T$ 114 is not shown and this tube would use a conventional type of power supply which surrounds the tube. The housing 144 includes a body portion 144, which is fabricated using the multi-layer ceramic structure explained earlier. This housing portion 144 provides for electrical interconnection of the $I^2T$ 114 with the power supply circuit by providing contact tabs 150*a,* 150*b,* 150*c,* and 150*d* outwardly exposed on the exterior surface of this housing portion.

The housing portion 144 defines a step 154 carrying an even number (again, six contact areas may be used, but the invention is not so limited) metallized contact areas 156 (again, in two sets 156*a* and 156*b*). Upon the contact areas 156*a* and 156*b* the housing 144 carries respective deformable metallic contact pad structures 156'. The MCP 124 is trapped upon step 154 and in electrical contact with the contact pads 156*a,* 56*b,* as was explained above. An axially extending insulative rim portion 122*a* of the PC 122 traps the MCP 124 on step 154 in contact with contact pads 156'.

However, in contrast to the embodiment of FIGS. 1–7, the alternative embodiment of FIGS. 8 and 9 provides for axial alignment of seal structures 152, and 158, respectively associated with the output window 120 and input window 116. Thus, as is seen in FIG. 8 and indicated by the force arrows "F" forces applied to the window member 116 and to the seal structure 152 as shown generally align with one another axially. In the case of the seal structure 152, this seal structure includes an annular metallic ring member 62, which is bonded to the window 120. This ring member 62 defines an annular basin or recess 64. Within the basin 64 is disposed an annular puddle 66 of sealing material including indium metal. This sealing material was explained above with reference to seal structure 58. To the housing portion 144 is sealingly attached a ring member 68, which includes an axially projecting knife edge portion 70. As is seen in FIG. 8, the knife edge portion 70 sealingly and bondingly sinks into puddle 66 because of assembly force "F."

Similarly, the seal structure 158 includes a ring member 148, which is bonded to the housing portion 144. This ring member 148 defines an annular basin or recess 74. Within the basin 74 is disposed an annular puddle 76 of sealing material including indium metal. FIG. 9 shows the seal structure 158 in a relationship and relative position preparatory to the uniting of these seal structure components to complete the structure seen in FIG. 8.

Again, the MCP 124 is placed on step 154, with the electrodes 124*a* and 124*b* in electrical contact with the appropriate ones of the contact pads 156' and underlying contact areas 156*a* and 156*b*. Then the window member 116, carrying PC 122 is positioned over the housing 144, and opposing forces (indicated by force arrows "F" in FIGS. 8 and 9) are applied. The result is that the window member 116 bonds at seal structure 158 to the housing 144, with the seal structure yielding and deforming to allow window member 116 to move axially toward housing 144. Simultaneously, the rib 122*a* contacts MCP 124, and applies force through this MCP structure so that the contact pads 156' also yield, deform, and allow the MCP 124 to move toward step 154. Once again, the MCP 122 and PC (i.e., window 116) both move axially and simultaneously toward the housing 144, maintaining the desired PC-to-MCP gap as the tube 114 is assembled.

While the present invention is depicted, described, and is defined by reference to preferred exemplary embodiments of the invention, such reference is not intended to imply a limitation on the invention, and no such limitation is to be inferred. The invention is subject to considerable modification and alteration, which will readily occur to those ordinarily skilled in the pertinent arts. For example, it is believed that the present invention can be implemented and practiced without making resource to the multi-layer unitary ceramic housing structure which is included in the preferred embodiments of the invention as presently disclosed. Further, the present invention is not limited to use in embodiments which produce an image directly for viewing at the tube. As was mentioned above, such devices as CCD's, CMOS image sensors, and other types of electronic transducers which will provide an image signal in response to an electron flux, may be used instead of or in addition to the display electrode assembly 26 of the present embodiments. Accordingly, the depicted and described preferred exemplary embodiments of the invention are illustrative only, and are not limiting on the invention. The invention is intended to be limited only by the spirit and scope of the appended claims, giving full cognizance to equivalents in all respects.

I claim:

1. A tube device responsive to photons of electromagnetic energy to produce an electrical response, said tube device comprising:

a device body holding a window member for passing photons of electromagnetic energy in a selected direction, a photocathode receiving said photons of electromagnetic energy and responsively releasing photoelectrons generally along said direction, a microchannel plate receiving said photoelectrons and responsively providing a shower of secondary-emission electrons generally moving in said selected direction;

said device body and said window member cooperating defining yieldably deformable sealing means for allowing relative movement of said photocathode relative to said tube body along said selected direction; and said device body further carrying an electrical contact pad in electrical contact with said microchannel plate.

2. The tube device of claim 1 further including yieldably deformable contact means for allowing said microchannel plate to move simultaneous along said selected direction in unison with said photocathode.

3. The tube device of claim 1 further including fine-dimension spacing structure extending between said photocathode and said microchannel plate and moving said microchannel plate in unison with said photocathode when said window member is moved in said selected direction by yielding deformation of said sealing means.

4. The tube device of claim 3 wherein said photocathode includes an active area, said fine-dimension spacing structure circumscribes said active area.

5. The tube device of claim 3 wherein said fine-dimension spacing structure is integral with said photocathode.

6. A tube device for amplifying light from a scene and providing an image signal, said tube device comprising: a body holding a front window for receiving light, a photocathode upon which the received light is directed to produce photoelectrons, a microchannel plate receiving the photoelectrons and responsively providing a shower of secondary emission electrons, and a transducer device receiving the shower of secondary emission electrons, and responsively providing an image signal; said body including a ring-like portion carrying electrical contact structure; said microchannel plate being disposed within said body and making electrical contact with said electrical contact structure; fine-dimension axially extending insulative spacing structure extending between and touching the photocathode and the microchannel plate to capture the microchannel plate in a selected axial position in said housing to establish a selected fine-dimension spacing between the microchannel plate and an active portion of the photocathode.

7. The tube device of claim 6 wherein said body further includes a yieldably deformable and axially-variable sealing structure sealingly uniting the body portion with said window member, said window member carrying said photocathode.

* * * * *